United States Patent [19]

Jespersen et al.

[11] 3,934,426

[45] Jan. 27, 1976

[54] THERMOSTATIC EXPANSION VALVE FOR REFRIGERATION INSTALLATIONS

[75] Inventors: Hans Jörgen Jespersen, Sonderborg; Leif Nielsen, Nordborg, both of Denmark

[73] Assignee: Danfoss A/S, Nordborg, Denmark

[22] Filed: Aug. 7, 1974

[21] Appl. No.: 495,387

[30] Foreign Application Priority Data

Aug. 13, 1973 Germany ..... 2340836

[52] U.S. Cl. ..... 62/205; 62/225; 62/DIG. 17

[51] Int. Cl.[2] ..... F25B 49/00

[58] Field of Search ..... 62/205, 225, DIG. 17, 204, 62/222

[56] References Cited

UNITED STATES PATENTS 2,614,393 10/1952 Schulz et al. ..... 62/225 X 2,922,292 1/1960 Lange ..... 62/225 X

*Primary Examiner*—William E. Wayner

[57] ABSTRACT

The invention relates to a thermostatic expansion valve assembly for refrigeration units. Condenser pressures are normally five to ten times greater in the summer than in the winter. In the assembly hereof the characterostic adjustment curve is made less dependent on the condenser pressure by reason of having two flow restricting zones in series in which one of the zones has a variable rate closing mode of operation which restricts flow at a constantly increasing rate as the condenser pressure rises.

6 Claims, 4 Drawing Figures

THERMOSTATIC EXPANSION VALVE FOR REFRIGERATION INSTALLATIONS

Figure 1:
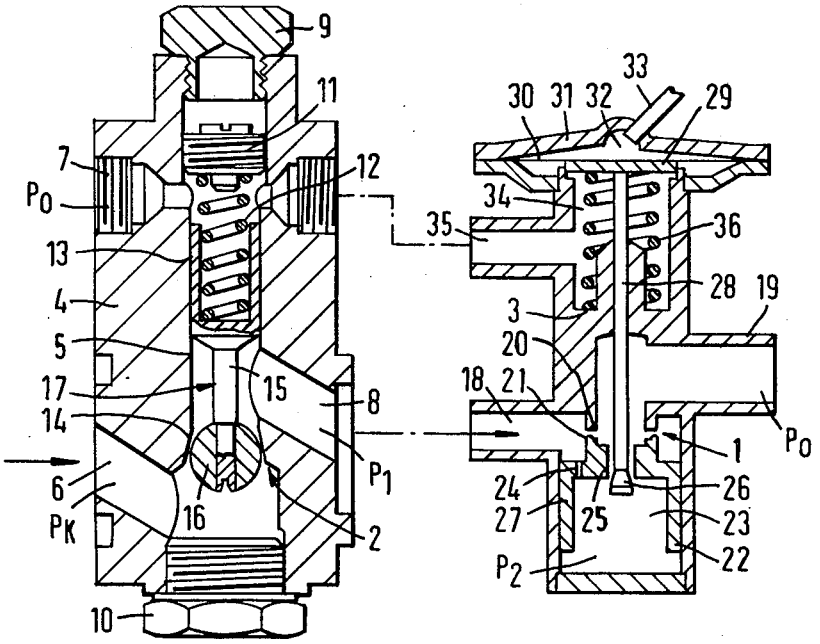

The invention relates to a thermostatic expansion valve for refrigeration installations, especially with an air-cooled condenser with an operating element which is dependent upon the superheat temperature of the evaporator and which influences a flow-restricting zone limited by a valve seat and a closing member.

Thermostatic expansion valves are fitted between the condenser and the evaporator of a refrigeration installation. Their function is to supply so much refrigerant to the evaporator that the superheat temperature at the end of the evaporator remains substantially constant. They must also be capable of providing a complete seal between the evaporator and the condenser. The operating element may also be acted upon by the suction pressure in order to achieve relief of pressure.

Whereas it can be assumed that the evaporator pressure is constant or undergoes only slight changes, the condenser pressure varies considerably in dependence upon the condenser temperature. In the case of air-cooled condensers, the condenser pressures that occur in summer are 5 – 10 times greater than those occurring in winter. Since a greater pressure-difference for a given position of the valve leads to a greater flow quantity, the factors upon which adjustment depends are quite different in summer from those occurring in winter. If the expansion valve is designed for summer-time operation, then in winter it lets through too little refrigerant even when fully open. If on the other hand the valve is designed for winter-time operation, the required flow-restriction cross-section is exceeded even at quite low superheat temperatures. In the case of expansion valves in which the inlet pressure is not compensated, there also occurs undesirable displacement of the closing member relative to the position dependent upon the superheat temperature, this displacement being dependent upon the condenser pressure.

The object of the present invention is to provide a thermostatic expansion valve of the initially described kind, the adjustment characteristic curve of which is considerably less dependent than heretofore upon fluctuations in the condenser pressure.

According to the invention this object is achieved by arranging in series with the first flow-restricting zone a second flow-restricting zone which restricts flow to a greater extent as the condenser pressure rises.

There is then provided the possibility of designing the first flow-restricting zone for, for example, operation at the lowest condenser pressure, since in this valve construction the entire pressure-drop between the condenser and the evaporator is distributed over two flow-restricting zones. Since, the higher the condenser pressure becomes the greater will be the restriction by the second flow-restricting zone, the pressure-drop occurring at the first flow-restricting zone can be kept relatively small. The first flow-restricting zone should therefore have a relatively large cross-section of opening even at high condenser pressures. This in turn means that, over the entire condenser pressure range, it is possible to maintain approximately constant superheat for example 6°C, for the fully opened condition.

A further advantage resides in the fact that the fairly great wear on the parts limiting the flow-restricting zones, that occurs with rising condenser pressure, can be mainly confined to the second flow-restricting zone where however wear is considerably less important than in the first flow-restricting zone since the second zone does not perform any closing function and wear cannot therefore adversely affect the seal.

Considerable advantage is achieved if the second flow-restricting zone has a displaceable element which, in one of the displacement directions is loaded by the condenser pressure and, in the other, by the evaporator pressure and by a reference spring. This reference spring is therefore compressed in dependence upon the pressure-drop at the entire expansion valve. The flow-restricting zone can therefore assume a specific opening position dependent upon the pressure-drop, i.e., upon the condenser pressure.

In a preferred embodiment, the second flow-restricting zone is disposed upstream of the first. In many cases this simplifies the construction of the valve since the second flow-restricting zone has in any case to be dependent upon the condenser pressure. On the other side the first flow-restricting zone is subjected to only a slight pressure during the process of adjustment, so that undesirable displacement of the temperature-responsive closure member because of loading by the inlet pressure is relatively small even in the case of uncompensated valves.

In a first preferred construction, and for the purpose of forming the second flow-restricting zone, there is provided a bore, which is formed in the housing and accommodates the displaceable element and which has a first port for connection to the condenser, a second port for connection to the evaporator and, between these, a third port for connection to the first flow-restricting zone, the displaceable element having a guide piston, disposed between the second and third ports, and a flow-restricting member connected to the guide piston and disposed upstream of the third port, and a backing member for the reference spring being provided at that end of the bore associated with the second port. This leads to a compact construction. In particular, the backing member for the reference spring may be screwed into the bore. The pressure-dependent adjustment characteristic curve of the second flow-restricting zone can then be adjusted to suit the particular circumstances.

Advantageously, the flow-restricting member may be a ball which has a diameter approximately equal to the diameter of the guide piston and which co-operates with a part of the bore which tapers from the first to the third port. The ball and the guide piston then have approximately equal surfaces that are subjected to the various pressures. Good adjustment response is achieved with a very small construction.

In this connection it is advisable for the first flow-restricting zone to be provided with a closing member in the form of a piston which is displaceable in the housing and one of the end-faces of which forms a main passage with the seat integral with the housing, and the other end-face of which bounds an intermediate pressure chamber which is connected to one of the ends of the first flow-restricting zone by way of a constant flow-restricting duct, and to the other end of the first flow-restricting zone by way of an auxiliary valve which consists of an auxiliary closing member, coupled to the operating element, and of a seat formed on the piston. With a first flow-restricting zone constructed in this way, undesirable application of pressure to the operating element is only likely to occur by way of the auxiliary closing member. However, since this auxiliary closing member has a very small cross-section and furthermore is only loaded by the relatively low intermediate pressure, there is virtually no interference with the superheat adjustment.

In another embodiment, the displaceable element of the second flow-restricting zone is displaceable on a cylindrical guide of the closing member of the first flow-restricting zone, and the reference spring is supported on a surface firmly connected to the closing member. In this construction the two flow-restricting zones are disposed close together. The seats may be provided concentrically with each other in the housing and at a short distance apart. In this construction the second flow-restricting zone, in addition to displacement in dependence upon the condenser pressure, is also displaced jointly with the closing member of the first flow-restricting zone. The desired objects can likewise be achieved with this construction.

For example, the displaceable element constitutes the flow-restricting member and is inserted in a cup-like closing member, and the space formed between the displaceable element and the closing member communicates with the inlet side of the valve. Since the free end of the displaceable element is subjected to the evaporator pressure, the required dependence upon the pressure-difference is achieved. The displaceable element is preferably made of a plastics material such as polytetrafluoroethylene, and is provided with a lip seal at that of its ends facing the bottom of the cup-like closing member. This lip seal enables the space communicating with the inlet side to be sealed off in a simple manner.

In a further arrangement the displaceable element constitutes the flow-restricting member and overlaps a cup-like closing member, and the space formed between the displaceable element and the closing member accommodates the reference spring and communicates with the outlet side of the valve. The free end of the displaceable element then faces the inlet pressure so that the required dependence upon the pressure-drop is again achieved. Expediently, a rod which is connected to the closing member and carries at its free end a stop for the displaceable element extends through this element. Then, even when no inlet pressure occurs, the displaceable element cannot be pushed away from the closing member by the reference spring.

Figure 4:
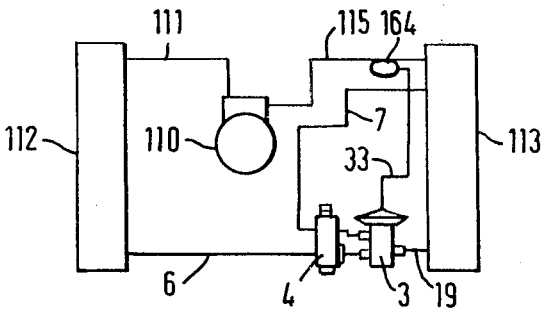
Figure 2:
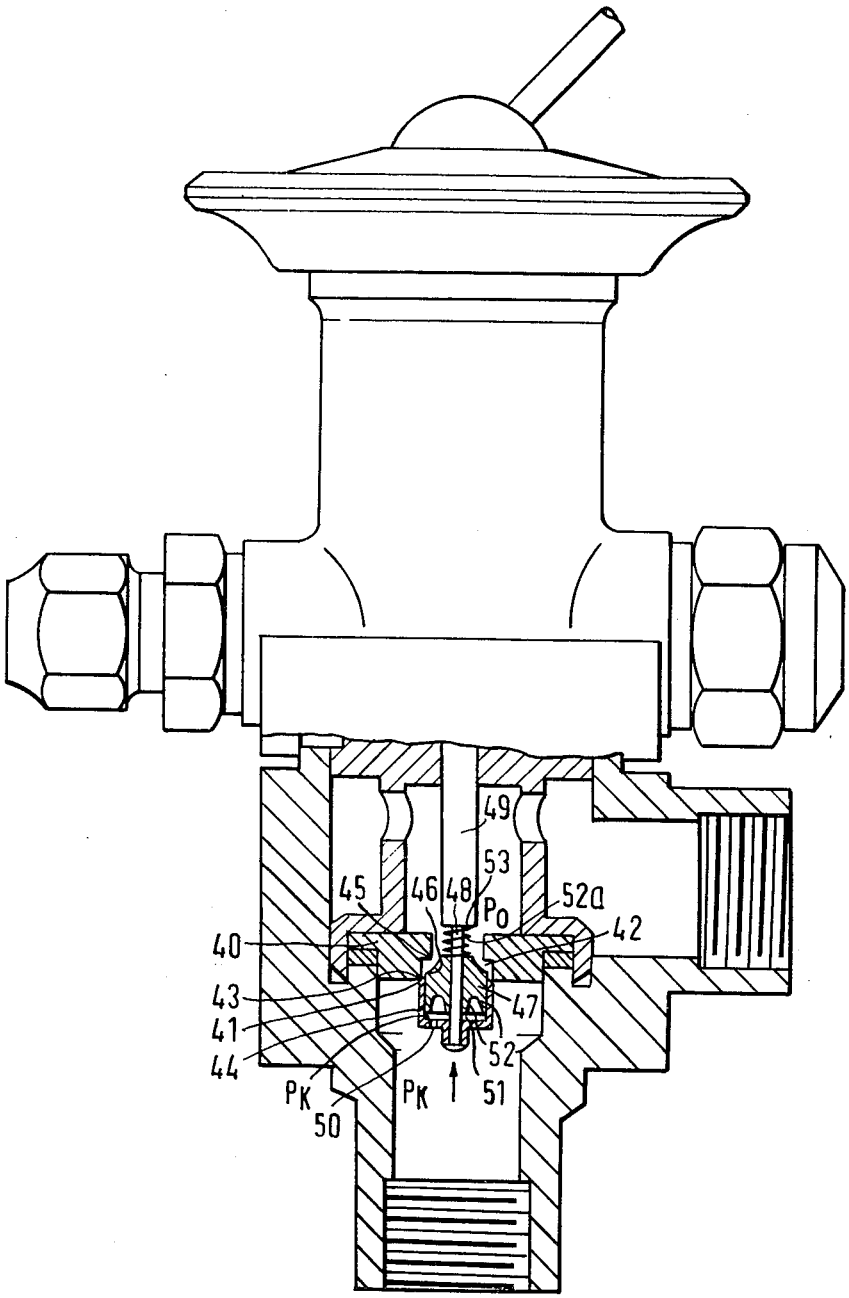
Figure 3:
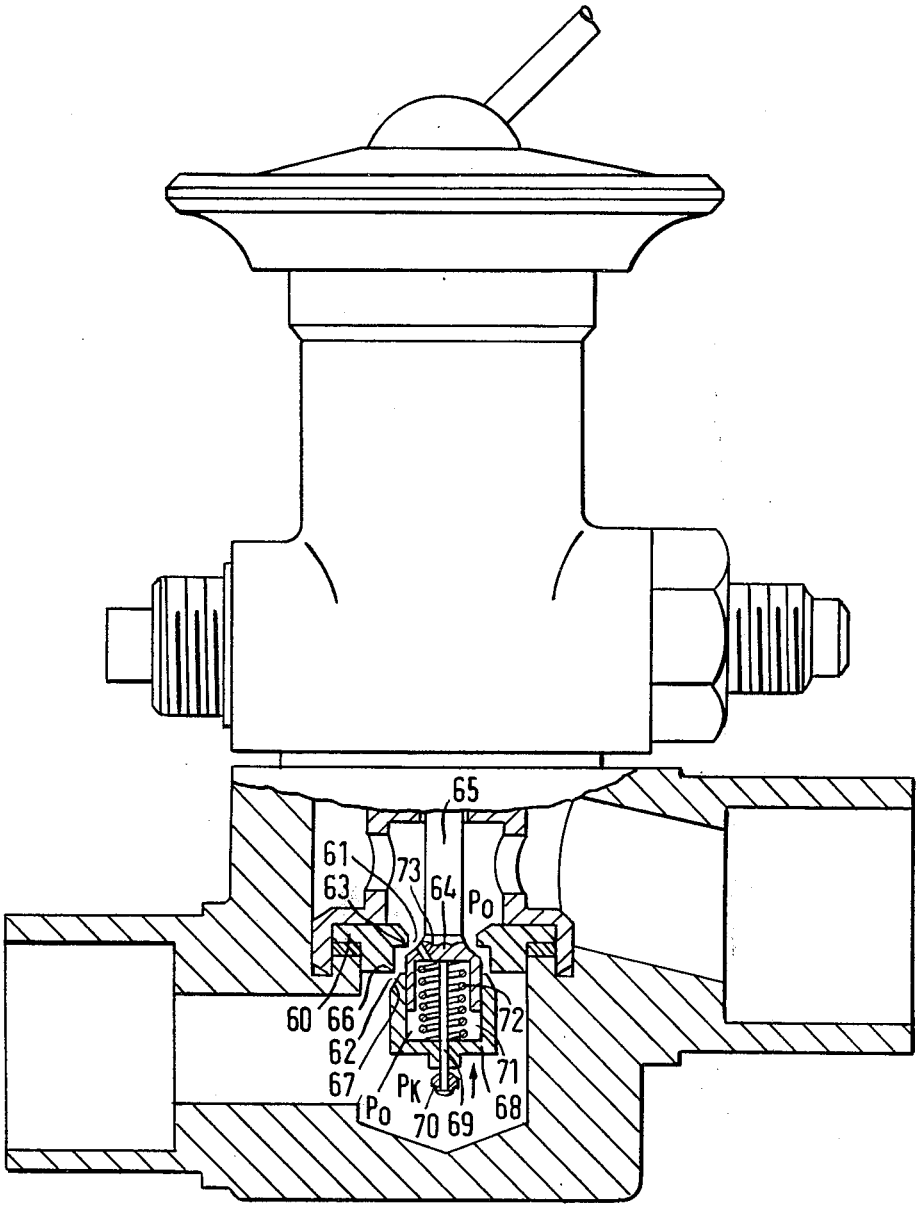

The invention will now be described in greater detail by reference to some preferred embodiments illustrated in the annexed drawings, in which:

FIG. 1 is a longitudinal section through a first form of construction of the expansion valve in accordance with the invention, FIG. 2 is a partial longitudinal section view through a second form of construction, FIG. 3 is a partial longitudinal section view through part of a third form of construction, and FIG. 4 is a schematic view of a conventional refrigeration system in which the expansion valve hereof is installed.

Referring first to FIG. 4, the thermostatic valve assembly is shown in a conventional refrigeration system which is shown schematically.

The system includes a compressor 110 connected by line 111 to a condenser 112. An evaporator 113 has the outlet thereof connected by a line 115 to the inlet of compressor 110. The thermostatic valve assembly of the present invention, which is illustrated as having separate housings 3 and 4, is connected to the outlet of condenser 112 by line 6 and to the inlet of evaporator 113 by a line 19.

A thermal sensing bulb 164 connected to the outlet of condenser 113 is connected to the unit 3 by line 33. Unit 4 is connected to the outlet end of condenser 113 by a line 7.

Referring now to FIG. 1, a thermostatic valve has two flow-restricting zones namely a first flow-restricting zone 1 and a second flow-restricting zone 2 which are disposed in two housings 3 and 4. These housings may be combined. Since the second flow-restricting zone 2 is disposed upstream of the first flow-restricting zone 1, it will be described first. The housing 4 has a bore 5 which has a first port 6 for connection to the condenser, a second port 7 for connection to the evaporator and, between these ports, a third port 8 for connection to the second flow-restricting zone 1. Consequently the condenser pressure $P_k$, the evaporator pressure $P_0$ and the throttled pressure $P_1$ obtain at the ports 6, 7 and 8 respectively. The bore is closed at the top by a screw 9 and at the bottom by a screw 10. At the top the bore has a screw-thread for receiving a backing surface 11 for a reference spring 12, and between the second and third ports it has a guide surface for a guide piston 13, whereas between the first and third ports it has a conical surface 14 which delimits the second flow-restricting zone 2. The guide piston 13 is connected to a spherical flow-restricting member 16 by a rod 15. The parts 13, 15 and 16 form a displaceable element 17.

The housing 3 has an inlet port 18 which communicates with the third port 8, and an outlet port 19 which communicates with the evaporator. Between the ports 18 and 19 is a valve seat 20 which forms part of the housing and which co-operates with a closing member 21. The closing member 21 is part of a piston 22 which is displaceable in the housing 3. Formed at the lower end of the piston is a space 23 which, by way of a constant flow-restricting gap 24, communicates with the space located outwardly of the valve seat 20, and by way of an auxiliary valve 25, consisting of a seat formed on the piston 22 and of an auxiliary closing member 26, communicates with the space located inwardly of the valve seat 20. The space 23 is sealed off by a sealing ring 27 on the piston 22. The auxiliary closing member 26 is connected by a rod 28 to a pressure plate 29. The latter is loaded by a diaphragm 30 of an operating element 31, the pressure chamber 32 of which communicates through a capillary tube 33 with a sensor bearing against the outlet of the evaporator. The space 34 below the diaphragm receives the evaporator pressure $P_0$ by way of a port 35, so that this pressure, together with the pressure of the required-value spring 36, counteracts the pressure in the space 32.

The flow-restricting zone 1 occupies an open position which is virtually dependent only upon the superheat temperature. If the auxiliary closing member 26 moves downwards when the temperature is higher, the piston 22 with the closing member 21 follows until the secondary stream of refrigerant, by way of the constant flow-restricting gap 24, the intermediate pressure chamber 23 and the auxiliary valve 25, has reached such an intermediate pressure $P_2$ that a state of equilibrium is achieved. This is present when the intermediate pressure $P_2$ times the entire area of the piston 22 is equal to the sum of the throttled pressure $P_1$ times the piston area outwardly of the valve seat 20, and the evaporator pressure $P_0$ times the piston area inwardly of the valve seat 20. The flow-restricting zone 1 is so designed that it opens fully at a superheat temperature of 6°C and, at the lowest condenser pressure to be expected, its opening is great enough to carry a sufficient quantity of refrigerant into the evaporator.

The displaceable element 17 is exposed to the effect of the condenser pressure $P_k$ at the lower face of the flow-restricting member 16, and to the effect of the evaporator pressure $P_0$ at the upper face of the guide piston 13 of like diameter. The mutually facing surfaces of the flow-restricting member 16 and of the guide piston 13 are exposed to the effect of the throttled pressure $P_1$, so that the action of this pressure is nullified. The displaceable element 17 is moved under the effect of the pressure-difference until equilibrium with the reference spring 12 is established. At the lowest condenser pressure the displaceable element 17 is moved so far downwardly that practically no flow-restricting action occurs. The greater the rise in the condenser pressure the farther is the flow-restricting member 16 pushed into the conical portion 14 and the greater is the throttling action of the flow-restricting zone 2. Suitable configuration of the flow-restricting zone 2, e.g., by the choice of a suitable taper in the conical portion 14, results in the pressure-drop at the second flow-restricting zone 2 for a given quantity, e.g., the maximum quantity of refrigerant being so great that the first flow-restricting zone 1 operates under approximately the same conditions irrespective of the condenser pressure $P_k$. In this way the required adjustment characteristic curve is obtained which, irrespective of the condenser pressure, operates with approximately the same quantities of refrigerant and superheat openings.

Referring to FIG. 2, a first flow-restricting zone 41 and a second flow-restricting zone 42 are arranged one immediately behind the other in a housing 40. The first flow-restricting zone is bounded by a valve seat 43 and a cup-like closing member 44. The second flow-restricting zone 42 is constituted by a valve seat 45 and part of a piston-like displaceable element 47 that is formed as a flow-restricting member 46. The cup-like closing member 44 is secured to an extension 48 of a valve spindle 49 which corresponds to the valve spindle 28 of FIG. 1. In the base of the closing member 44 is a hole 50 through which the space upstream of the first flow-restricting zone communicates with an inner space 51 between the closing member 44 and the displaceable element 47. The displaceable element 47 is made of a plastics material and has sealing lips 52 which also seal off the space 51. A reference spring **52*a* is supported at one end on the displaceable element 42 and at the other on a backing surface 53 connected to the spindle 49 and therefore to the closing member 44.**

The first flow-restricting zone 41 which also serves to close the valve is displaced in dependence upon the operating element 31. The displaceable element 47 also participates in this basic movement so that the second flow-restricting zone 42 is also changed. Since, because of the presence of the hole 50, the condenser pressure $P_k$ obtains in the space 51, the displaceable element 47 is acted upon by the pressure-difference at the valve and by the reference spring. Depending upon the condenser pressure this element therefore assumes a particular position relative to that of the closing member 44, so that the second flow-restricting zone is corrected in dependence upon pressure.

In the form of construction shown in FIG. 3, a first flow-restricting zone 61 is disposed in a housing 60 and upstream thereof there is provided a second flow-restricting zone 62. The first flow-restricting zone is formed by a valve seat 63 and a closing member 64. The latter is connected to a valve spindle 65 which corresponds to the valve spindle 28 of FIG. 1. The second flow-restricting zone is formed by a valve seat 66 and a part of a displaceable element 68 that serves as a flow-restricting member 67, said element being guided on an extension rod 69 and being secured by a stop 70. Between the closing member 64 and the displaceable element 68 there is formed a space 71 which accommodates the reference spring 72 and communicates through a bore 73 with the outlet on the evaporator side.

The first flow-restricting zone 61 is displaced in dependence upon the operating element 31. This leads to displacement of the second flow-restricting zone in the same direction. The displaceable element 68 is loaded at the top by the evaporator pressure $P_0$ and by the reference spring 72, and at the bottom by the condenser pressure $P_k$. Consequently this element 68 is displaced relatively to the closing member 64 so that the second flow-restricting zone 62 is corrected in dependence upon pressure.

We claim:

1. A thermostatic expansion valve assembly for a refrigeration system having an evaporator and an air cooled condenser, comprising, an operating element dependent upon the superheat temperature of said evaporator, a first flow passage having a first valve unit operated by said operating element, a second flow passage having a second valve unit in series with said first valve unit which closes at a variable rate which increases as the condenser pressure rises, a reference spring and a displaceable element for operating said second valve unit, said displaceable element being biased in one direction by condenser pressure and in the other direction by evaporator pressure and said reference spring.

2. A thermostatic expansion valve assembly according to claim 1 wherein said second valve unit is upstream from said first valve unit.

3. A thermostatic expansion valve assembly according to claim 1 including a housing having a bore in which said displaceable element is disposed, first and second ports having fluid communication with said bore for respective connection to said condenser and said evaporator, a third port having fluid communication with said bore and said first valve unit, said displaceable element having a guide piston between said second and third ports, a flow restricting member connected to said guide piston and being disposed upstream of said third port.

4. A thermostatic expansion valve assembly according to claim 3 wherein said flow restricting member is ball shaped with a diameter equal to the diameter of said guide piston, said bore having a taper between said first and third ports, said flow restricting member being cooperable with said taper.

5. A thermostatic expansion valve assembly according to claim 1 wherein said first valve unit includes a valve seat, a cylindrical chamber and a valve piston displaceable in said cylindrical chamber and being cooperable with said valve seat, a flow restricting duct in said valve piston providing fluid communication between said cylindrical chamber and the upstream side of said first flow passage, an auxiliary valve in said valve piston providing fluid communication between said cylindrical chamber and the downstream side of said first flow passage, said auxiliary valve being coupled to said operating element.

6. A thermostatic expansion valve assembly according to claim 1 wherein said second valve unit includes first and second valve seats, a cup shaped member cooperable with said second valve seat, a piston member slidably disposed in said cup shaped member to form an expansible chamber and being cooperable with said first valve seat, a flow restricting duct providing fluid communication between said expansible chamber and the upstream side of said second flow passage.

* * * * *